US007959193B2

(12) United States Patent
Ng

(10) Patent No.: US 7,959,193 B2
(45) Date of Patent: Jun. 14, 2011

(54) KNOTTER

(75) Inventor: Tony C. Ng, East Brunswick, NJ (US)

(73) Assignee: McNeil-PPC, Inc., Skillman, NJ (US)

( * ) Notice: Subject to any disclaimer, the term of this patent is extended or adjusted under 35 U.S.C. 154(b) by 0 days.

(21) Appl. No.: 12/678,501

(22) PCT Filed: Sep. 30, 2008

(86) PCT No.: PCT/US2008/078290

§ 371 (c)(1),
(2), (4) Date: Mar. 17, 2010

(87) PCT Pub. No.: WO2009/043060

PCT Pub. Date: Apr. 2, 2009

(65) Prior Publication Data

US 2010/0194110 A1 Aug. 5, 2010

Related U.S. Application Data

(60) Provisional application No. 60/976,103, filed on Sep. 28, 2007.

(51) Int. Cl.
*B65H 69/04* (2006.01)

(52) U.S. Cl. ..... 289/15

(58) Field of Classification Search ..... 289/1.5, 289/2, 15, 18.1
See application file for complete search history.

(56) References Cited

U.S. PATENT DOCUMENTS

| | | | | |
|---|---|---|---|---|
| 876,573 | A * | 1/1908 | Myers | 53/138.7 |
| 1,926,900 | A | 9/1933 | Haas | |
| 3,336,063 | A | 8/1967 | Remmers | |
| 3,422,496 | A | 1/1969 | Wolff et al. | |
| 3,490,801 | A * | 1/1970 | Feighery | 289/2 |
| 3,811,445 | A | 5/1974 | Dostal | |
| 3,983,875 | A | 10/1976 | Truman | |
| 4,836,587 | A | 6/1989 | Hinzmann | |
| 5,911,712 | A | 6/1999 | Leutwyler et al. | |
| 6,310,296 | B1 | 10/2001 | Nishi et al. | |
| 6,554,814 | B1 | 4/2003 | Agyapong et al. | |
| 6,585,300 | B1 | 7/2003 | Rajala et al. | |

FOREIGN PATENT DOCUMENTS

| | | | |
|---|---|---|---|
| GB | 1236348 | A | 6/1971 |
| GB | 1398817 | A | 6/1975 |
| JP | 2006176333 | A | 7/2006 |
| NL | 6411624 | A | 10/1965 |

* cited by examiner

*Primary Examiner* — Shaun R Hurley

(57) ABSTRACT

Apparatus for knotting at least one string of material has a fixed knotter plate, a primary knotter plate, a secondary knotter plate, means to apply tension to the string, and means for threading the string through the knotter plates.

5 Claims, 2 Drawing Sheets

KNOTTER

This application is the national stage filing under 371 of international application PCT/US2008/078290 filed on Sep. 30, 2008, which claims the benefit of U.S. provisional application 60/976,103 filed on Sep. 28, 2007.

FIELD OF THE INVENTION

The present invention relates to an apparatus and method for tightly knotting one end of a string. More particularly, the invention relates to securing a knot in the end of a tampon withdrawal string and tightening the knot.

BACKGROUND OF THE INVENTION

Devices for capturing and storing bodily fluid intravaginally are commercially available and known in the literature. Intravaginal tampons are the most common example of such devices. Commercially available tampons are generally compressed cylindrical masses of absorbent fibers that may be over-wrapped with an absorbent or nonabsorbent cover layer. A means for withdrawing the tampon may include a withdrawal string, which may be attached by various means. It is important that the string be securely attached to the tampon with sufficient strength such that it is capable of withdrawing the tampon without the string breaking or disengaging.

The tampon is inserted into the human vagina and retained there for a time for the purpose of capturing and storing intravaginal bodily fluids, most commonly menstrual fluid. The tampon may be inserted manually or by use of an applicator. Withdrawal from the vagina is accomplished by pulling on end of the string with a force sufficient until the tampon slides. Since the vagina exerts pressure on the tampon, the force required to disengage the tampon may be significant. Because of this, it is helpful to knot the end of the withdrawal string, thereby giving the user something to grip onto.

Examples of apparatuses and methods for making knots for use as withdrawal strings in tampons can be found in U.S. Pat. No. 4,836,587; U.S. Pat. No. 6,585,300; GB 1236348; and GB 1398817. These apparatuses are complex and not designed for the newer high speeds desired in current manufacturing. The string may be subjected to additional forces, which may weaken the string. Additionally, the resultant knot is has a loose configuration and may unwind during packing and the shipping of the product. For these reasons, there remains a need for a new, robust method and apparatus for tightly forming a knot in the end of a string, particularly in the process of making sanitary protection articles such as tampons.

GB 1236348 purports to disclose a device for forming knots in yarn, thread or the like. The device has a body made of two parts that have passages corresponding to the looped form of the knot being made. The passages are connected to a vacuum for drawing one end of the yarn through the passages. The crossing points of the passages are located in a plane of separation. The crossing points are separated by resilient tongues that permit the yarn to be pulled through the passages to form a knot. The resilient tongues permit the yarn to "break through" to pull the knotted yarn ends out of the channel without destroying the loop.

Knots invariably weaken the string they are made in. When knotted string is strained to its breaking point, barring any flaws or damage in the string itself, the string almost always fails in or near the knot. The same bending, crushing, and chafing forces that produce the friction that holds a knot in place are also responsible for unevenly stressing the string fibers and ultimately lead to the reduction of strength. The exact mechanisms that cause the weakening and failure are complex, and these mechanisms are the subject of continued study.

The relative knot strength, also called knot efficiency, is the breaking strength of a knotted string expressed as a percentage of the breaking strength of the string without the knot. There are many difficulties in determining the overall numeric knot efficiency for a given knot. This is due to the many factors that can affect the results of a knot efficiency test: the type of fiber, the style of string, the size of string, whether it is wet or dry, how the knot is dressed before loading, how rapidly the knot is loaded, whether the knot is repeatedly loaded, and so on. With those limitations noted, and in order to give a sense of how much loss of strength knots cause, most knots in common usage have an efficiency between 40% and 80%.

The tension from a load causes the string to work back through the knot in the direction of the load. If this continues far enough the working end will pass into the knot and the knot will unravel and fail. This behavior in knots can be worsened when the knot is repeatedly strained and let slack, dragged over rough terrain, or subject to repeated impacts such as against a mast or flagpole. Even with secure knots some slippage may occur as the knot is first put under real tension. This can be dealt with by leaving plenty of string at the working end outside of the knot and by dressing the knot cleanly and tightening it as fully as possible before loading. In some cases the use of a stopper knot or, even better, a backup knot can prevent the working end from passing through the knot, but it is generally better to use a more secure knot if one is observed to slip. In life critical uses backup knots are often added to already secure knots in order to maximize safety.

What is needed is a device that reliably and efficiently forms tightened knots in the loose end of a string.

SUMMARY OF THE INVENTION

It has been discovered that the problem of tightly knotting a thread or withdrawal string can be addressed in a surprising and different way. By using a moving part to catch the end of the string after knot formation, the string is pulled tautly, which results in a tight knot.

An apparatus for knotting at least one string of material has a fixed knotter plate, a primary knotter plate, a secondary knotter plate, a press shoe, and a vacuum source. The string has a first end and second end. The fixed knotter plate has a first surface and a second surface, each surface having an aperture such that a conduit is formed from the first aperture on the first surface to the second surface. The primary knotter plate has a first surface and a second surface. Each surface has an aperture such that a conduit is formed from the first surface to the second surface. The first surface further includes a primary pathway formed thereon having a first end and a second end. The first end is aligned with the aperture of said second surface of the fixed knotter plate. The secondary knotter plate has a first surface, a second surface and a third surface. The third surface has formed therein a secondary pathway extending to the second surface forming two apertures, wherein when the apertures of the second surface of the secondary knotter plate are aligned with the primary pathway and the aperture of the first surface of the primary knotter plate, thereby forming a closed conduit from the first aperture of the fixed knotter plate to the second aperture of the primary knotter plate. The press shoe has a first surface, a second surface, each surface having an aperture such that a conduit is formed from the first surface to the second surface. The aperture of said first surface of said press shoe is aligned with second aperture of said primary knotter plate. The vacuum source contacts the aperture of said second surface of the press shoe. The primary knotter plate, secondary knotter plate and press shoe may be mounted on a slide block such that upon drawing of said vacuum, said second end of said string of material enters into said first aperture of said fixed knotter plate, progresses into said aperture of first surface of primary knotter plate, is drawn into the groove of said secondary knotter plate and through the conduit of the primary knotter plate into the conduit of the press shoe. When the slide block moves away from the fixed knotter, said press shoe is urged upward to hold the string in a stationary position between said press shoe and said second surface of said primary knotter plate. This permits the knot to be tightened.

Alternatively, apparatus for knotting at least one string of material has a fixed knotter plate, a primary knotter plate, a secondary knotter plate, means to apply tension to the string, and means for threading the string through the knotter plates. The fixed knotter plate has a first surface and second surface. Each surface has a respective aperture connected by a conduit. The primary knotter plate has a first surface and a second surface, each surface having respective first and second apertures and a conduit formed between the apertures. Additionally, the first surface incorporates a primary curved pathway. This primary curved pathway has a first end and a second end. The first end of the primary curved pathway is aligned with the aperture of said second surface of the fixed knotter plate. The secondary knotter plate has a first surface, a second, opposite surface, and a third surface. The third surface has a secondary curved pathway. A first end of the secondary curved pathway can be aligned with the second end of the primary curved pathway, and the second end of the secondary curved pathway can be aligned with the first aperture of the primary knotter plate when the apparatus is in a first, closed position. This permits the string to form an open loop with its distal end extending out of the second aperture of the primary knotter plate and into a press shoe aperture.

BRIEF DESCRIPTION OF THE DRAWING

FIGS. 4A-C illustrate three perspective views of a knotter during relative movement of a string and the individual plates of the knotter apparatus of FIGS. 2 and 3.

DETAILED DESCRIPTION OF THE PREFERRED EMBODIMENTS

As used herein in the Specification and the Claims, the term "string" shall mean any type of thread or material that is elongated. Included in this definition is yarn, thread, string, wire or any other flexible material which can be knotted manually.

In one embodiment, this invention relates to devices (e.g., intravaginal tampons, nasal tampons) for capturing and storing bodily fluid. More particularly, the invention relates to an improved intravaginal tampon having at least one withdrawal string for removing the tampon from the user's body cavity. In one embodiment, the tampon has a compressed core portion.

Absorbent tampons are usually substantially cylindrical masses of compressed absorbent material having a central axis and a radius that defines the outer circumferential surface of the tampon. Such tampons are disclosed in e.g., Haas, U.S. Pat. No. 1,926,900; Dostal, U.S. Pat. No. 3,811,445; Wolff, U.S. Pat. No. 3,422,496; Friese et al., U.S. Pat. No. 6,310,296; Leutwyler et al., U.S. Pat. No. 5,911,712, Truman, U.S. Pat. No. 3,983,875; Agyapong et al., U.S. Pat. No. 6,554,814. Tampons also usually include a fluid-permeable cover (which may include or be replaced by another surface treatment) and a withdrawal string or other removal mechanism.

Absorbent materials useful in the formation of the absorbent body include fiber, foam, superabsorbent, hydrogels, and the like. Preferred absorbent material for the present invention includes foam and fiber. Absorbent foams may include hydrophilic foams, foams that are readily wetted by aqueous fluids as well as foams in which the cell walls that form the foam themselves absorb fluid.

Fibers may be selected from cellulosic fiber, including natural fibers (such as cotton, wood pulp, jute, and the like) and synthetic fibers (such as regenerated cellulose, cellulose nitrate, cellulose acetate, rayon, polyester, polyvinyl alcohol, polyolefin, polyamine, polyamide, polyacrylonitrile, and the like).

Figure 1:
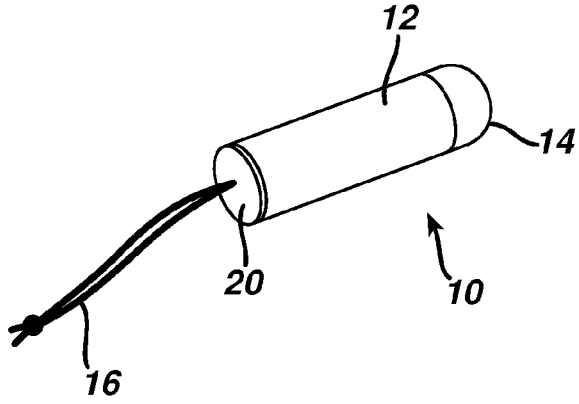
FIG. 1 PRIOR ART
FIG. 1 shows a tampon, such as may incorporate a knotted string according to the present invention.

As shown in FIG. 1, the tampon 10 may be substantially enclosed by a fluid-permeable cover 12. Either or both ends of the tampon may be enclosed by the cover. Of course, for processing or other reasons, some portions of the surface of the tampon may be free of the cover. For example, the insertion end 14 of the tampon and a portion of the cylindrical surface adjacent this end may be exposed, without the cover to allow the tampon to more readily accept fluids. A withdrawal mechanism, such as withdrawal string 16, is joined to the tampon 10 for removal after use.

The fluid-permeable cover 12 can ease the insertion of the tampon into the body cavity and can reduce the possibility of fibers being separated from the tampon. Useful covers are known to those of ordinary skill in the art. They may be selected from an outer layer of fibers which are fused together (such as by thermobonding), a nonwoven fabric, an apertured film, or the like. Preferably, the cover has a hydrophobic finish.

Figure 2A:
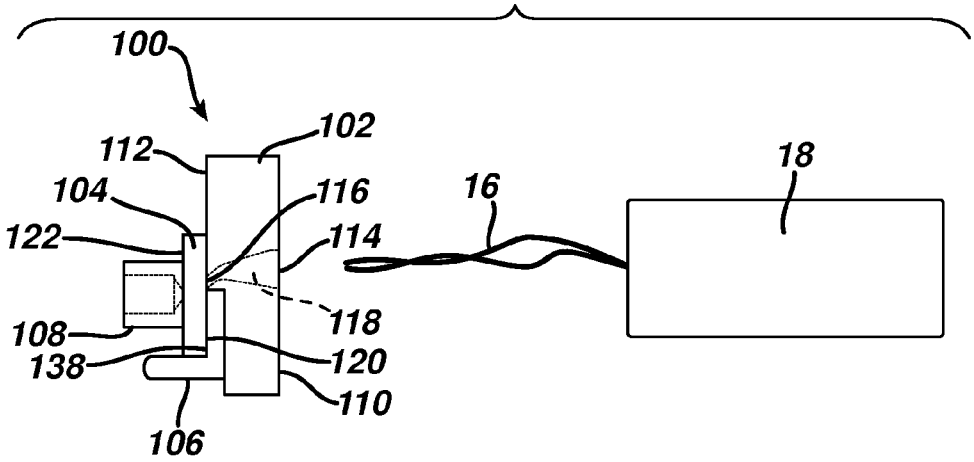
FIGS. 2A-B illustrate a plan and side view, respectively of a knotter according to the present invention.

To form a tampon ready for use, an intermediate structure 18 (e.g., as shown in FIG. 2A) is typically compressed and heat conditioned in any suitable conventional manner. Pressures and temperatures suitable for this purpose are well known in the art. Typically, the intermediate structure 18 is compressed in both the radial and axial direction using any means well known in the art. While a variety of techniques are known and acceptable for these purposes, a modified tampon compressor machine available from Hauni Machines, Richmond, Va., is suitable.

The tampon 10 of the present invention may be inserted digitally or through the use of an applicator. If the tampon 10 is to be used for digital insertion, it may be desirable to form the pledget from a layer of absorbent material that has been rolled into a cylindrical shape.

Any of the currently available tampon applicators may also be used for insertion of the tampon of the present invention. Such applicators of typically a "tube and plunger" type arrangement and may be plastic, paper, or other suitable material. Additionally, a "compact" type applicator is also suitable. The applicator plunger will push the tampon 10 out of an applicator (not shown) due to the compressed nature of the product.

The withdrawal mechanism 16 is preferably joined to at least the tampon 10 and extends beyond at least the tampon's withdrawal end 20. Any of the withdrawal strings currently known in the art may be used as a suitable withdrawal mechanism, including without limitation, braided (or twisted) cord, yarn, etc. In addition, the withdrawal mechanism can take on other forms such as a ribbon, loop, tab, or the like (including combinations of currently used mechanisms and these other forms). For example, several ribbons may be twisted or braided. For ease of description, the term "withdrawal string" or "string" will be used generically as the withdrawal mechanism.

In one embodiment, the knotter of the present invention forms a single or overhand knot. While this type of knot is sufficient for use on the end of a tampon withdrawal string, other knots are possible. A significant use of the knot is to provide the user a gripping element to provide resistance to slippage when the user wishes to remove the tampon after use.

Figure 2B:
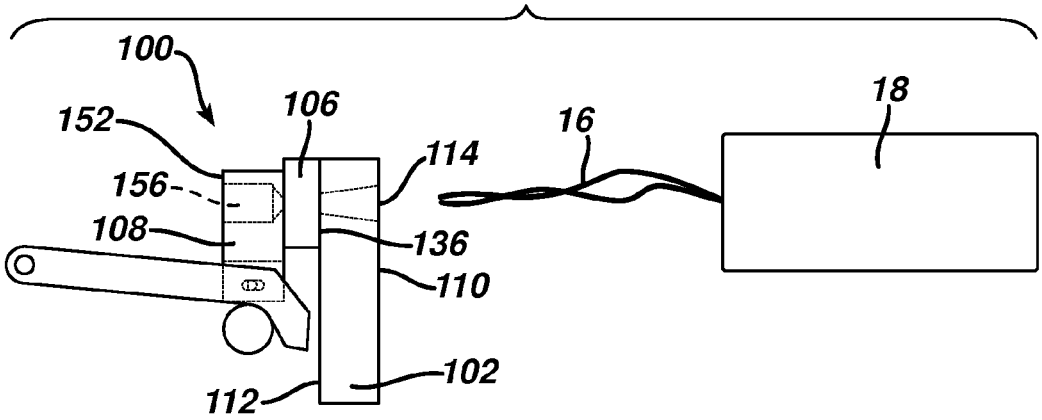

The knotter apparatus 100 of FIGS. 2-4 includes four parts and is in communication with a vacuum source: fixed knotter plate 102, a primary knotter plate 104, a secondary knotter plate 106, and a press shoe 108. Each will now be described in greater detail.

The string 16 initially enters into the knotting apparatus 100 through the fixed knotter plate 102. The fixed knotter plate 102 can have a block configuration, which has a first surface 110 and second surface 112. Each surface has a respective aperture 114, 116; the apertures 114, 116 are connected by conduit 118. In one embodiment, the first surface 110 is the outwardly facing surface of the fixed knotter plate 102. The string 16 feeds into the aperture 114 on the first surface 110 and exits the fixed knotter plate 102 through the aperture 116 on the second surface 112. The second surface 112 contacts a first surface 120 of the primary knotter plate 104 (shown FIG. 2A). In one embodiment, the aperture 114 on the first surface 110 (fixed plate) is significantly larger that the aperture 116 on the second surface 112 such the conduit 118 is somewhat funnel shaped. A larger aperture 114 on the first surface 110 aids in drawing the string 16 into the conduit 118. Additionally, the apertures 114,116 may be offset or may be aligned perpendicular to the first surface 110 of the fixed knotter plate 102.

The primary knotter plate 104 has a first surface 120 and a second surface 122, each surface having respective first and second apertures 124,126 such that a conduit 128 is formed between the surfaces. Additionally, a primary curved pathway 130 is formed in the first surface 120. This primary curved pathway 130 has a first end 132 and a second end 134. The first end 132 of the primary curved pathway 130 is aligned with the aperture 116 of said second surface 112 of the fixed knotter 102. The string 16 follows this primary curved pathway 130 in order to form a loop of the string 16.

Figure 3A:
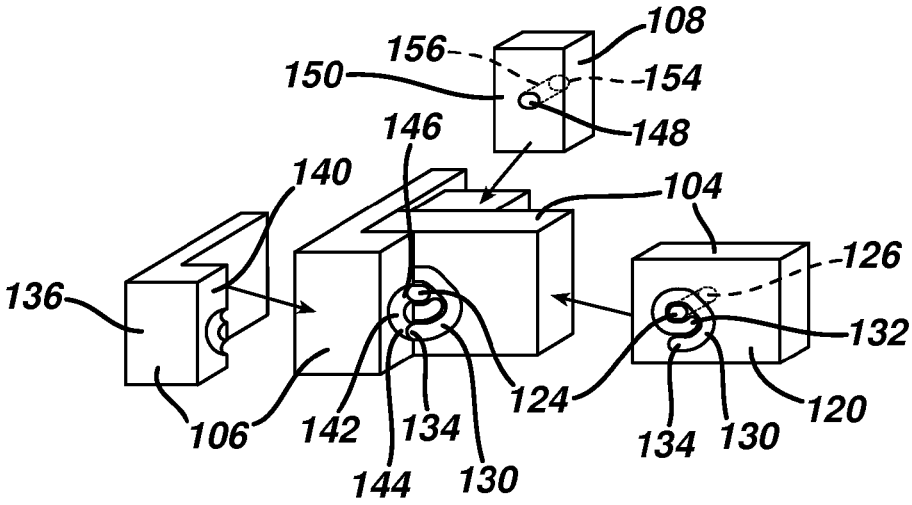
FIGS. 3A-B illustrate exploded perspective views of a knotter of the present invention.
Figure 3B:
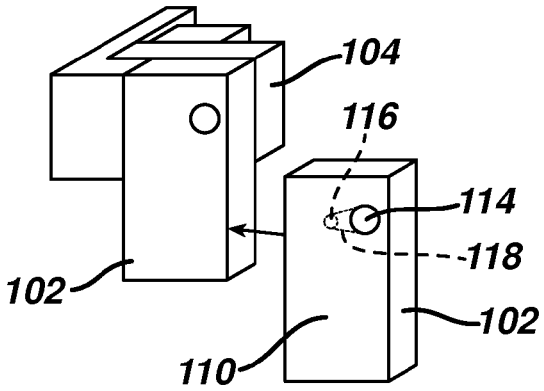

The secondary knotter plate 106 has a first surface 136, a second, opposite surface 138, and a third surface 140. As shown in FIG. 3A, the third surface 140 has a secondary curved pathway 142. A first end 144 of the secondary curved pathway 142 can be aligned with the second end 134 of the primary curved pathway 134, and the second end 146 of the secondary curved pathway 142 can be aligned with the first aperture 124 of the primary knotter plate 104 when the apparatus is in a first, closed position (as shown in FIG. 3B and FIG. 4A) to permit the string 16 to form an open loop with its distal end extending out of the second aperture 126 of the primary knotter plate 104 and into a press shoe aperture 148.

The press shoe 108 provides means to apply tension to the string 16, especially after forming the knot. In the embodiment of FIGS. 2 and 4, the press shoe 108 is slidable perpendicular to the axis of the conduit 128 of the primary knotter plate 104. This permits the string 16 to be held between the second surface 122 of the primary knotter plate 104 and the press shoe 108. The pressure between the press shoe 108 and the primary knotter plate 104 may be adjusted to provide the desired tension in the string 16 as it is withdrawn from the apparatus 100.

Other examples of the means to apply tension may include without limitation, a reduced aperture formable proximate the fixed plate aperture 114, a clamp located proximate the primary knotter plate second aperture 126, and the like.

In the embodiment of FIGS. 2-4, the press shoe 108 has basically a block configuration with a first surface 150 and a second surface 152. The first surface 150 has an aperture 148, and the second surface 152 has a vacuum port 154 such that a conduit 156 is formed from the aperture 148 of the first surface 150 to the vacuum port 154. The aperture 148 of the first surface 150 of the press shoe 108 is aligned with the second aperture 126 of the primary knotter plate 104.

A vacuum source is disposed in fluid communication with the vacuum port 154. Thus, a vacuum may be drawn in the knotter apparatus 100 to pull the string into the knotter apparatus 100 into aperture 114 on the first surface 110 of the fixed knotter plate 102.

The vacuum system may embody various suitable means for timing application of vacuum to the vacuum port 154. For example, conventional programmable vacuum valves may be used.

What is claimed is:

1. An apparatus for knotting at least one string of material having a first end and second end comprising:

a) a fixed knotter plate having a first surface and a second surface, each surface having an aperture such that a conduit is formed from the first aperture on the first surface to the second surface;

b) a primary knotter plate having a first surface and a second surface, wherein:

i) each surface of the primary knotter plate has an aperture such that a conduit is formed from the first surface to the second surface of the primary knotter plate;

ii) the first surface of the primary knotter plate includes a primary pathway formed thereon having a first end aligned with the aperture of said second surface of the fixed knotter plate and a second end c) a secondary knotter plate having a first surface, a second surface and a third surface, the third surface having formed therein a secondary pathway extending to the second surface forming two apertures, wherein when the apertures of the second surface of the secondary knotter plate are aligned with the primary pathway and the aperture of the first surface of the primary knotter plate, thereby forming a closed conduit from the first aperture of the fixed knotter plate to the second aperture of the primary knotter plate;

d) a press shoe having a first surface and a second surface, each press shoe surface having an aperture such that a conduit is formed from the first surface to the second surface, wherein the aperture of said first surface of said press shoe is aligned with second aperture of said primary knotter plate; and e) a vacuum source.

2. The apparatus of claim 1 further comprising a slide block to which the primary knotter plate, secondary knotter plate, and the press shoe are operatively connected.

3. The apparatus of claim 2, wherein the press shoe, fixed knotter plate, and slide block are arranged and configured such that as the slide block is moved away from the fixed knotter, the press shoe is urged upward to hold the string in a stationary position between the press shoe and the second surface of the primary knotter plate to permit a knot formed in the apparatus to be tightened.

4. An apparatus for knotting at least one string of material having a first end and second end comprising:

a) a fixed knotter plate having a first surface and a second surface, each surface having an aperture such that a conduit is formed from the first aperture on the first surface to the second surface;

b) a primary knotter plate having a first surface and a second surface, wherein:

i) each surface of the primary knotter plate has an aperture such that a conduit is formed from the first surface to the second surface of the primary knotter plate;

ii) the first surface incorporates a primary curved pathway having a first end and a second end; and iii) the first end of the primary curved pathway is aligned with the aperture of said second surface of the fixed knotter plate;

c) a secondary knotter plate having a first surface, a second surface and a third surface, the third surface having formed therein a secondary curved pathway, wherein a first end of the secondary curved pathway is arranged and configured to be aligned with the second end of the primary curved pathway, and the second end of the secondary curved pathway is arranged and configured to be aligned with the first aperture of the primary knotter plate when the apparatus is in a first, closed position;

d) means to apply tension to the string; and e) means for threading the string through the knotter plates.

5. A method of knotting a string comprising the steps of:

a) drawing a first end of a string:

i) into a first aperture on a first surface of a fixed knotter plate, ii) through a fixed knotter plate conduit, and iii) out of the fixed knotter plate through the a second aperture disposed on the second surface of the fixed knotter plate so the first end of the string extends beyond the second aperture of the fixed knotter plate;

b) drawing the first end of a string extending beyond the second aperture of the fixed knotter plate:

i) into a first end of a primary curved pathway disposed on a first surface of a primary knotter plate and substantially encircling a first primary knotter plate aperture, the first end of the curved pathway being substantially aligned with the second aperture of the fixed knotter plate wherein the first surface of the primary knotter plate defines a first plane, and ii) along the primary curved pathway to a second end so the string encircles the first primary knotter plate aperture and the first end of the string extends beyond a second end of the primary curved pathway;

c) drawing the first end of a string extending beyond the second end of the primary curved pathway:

i) into a first end of a secondary curved pathway disposed on a surface of a secondary knotter plate, the first end of the secondary curved pathway being substantially aligned with the second end of the primary curved pathway of the primary knotter plate, wherein the secondary curved pathway is disposed substantially perpendicular to the first plane, ii) along the secondary curved pathway to a second end thereof and into the first primary knotter plate aperture when the apparatus is in a first, closed position, and iii) through a primary knotter plate conduit and out to extend beyond a second primary knotter plate aperture disposed in a surface, opposite the first surface of the primary knotter plate wherein the string forms an open loop with its distal end extending out of the second aperture of the primary knotter plate;

d) drawing the first end of a string extending out of the second aperture of the primary knotter plate into a press shoe aperture substantially aligned with the second aperture of the primary knotter plate;

e) separating the secondary knotter plate from at least one adjacent knotter plate to release the string from the secondary curved pathway to form a loose knot;

f) adjusting the press shoe to hold the first end of the string between the press shoe and the primary knotter plate proximate the second aperture of the primary knotter plate; and g) tensioning the string to tighten the knot.

* * * * *